United States Patent [19]

March

[11] 3,987,566

[45] Oct. 26, 1976

[54] CARD DISPLAY DEVICE

[76] Inventor: Anthony J. March, 2 S. 173 Stratford Road, Glen Ellyn, Ill. 60137

[22] Filed: Oct. 20, 1975

[21] Appl. No.: 623,674

[52] U.S. Cl. ..... 40/124.4; 229/22

[51] Int. Cl.[2] ..... G09F 1/08

[58] Field of Search ..... 40/124.4, 124.2, 124, 40/124.1, 126 A; 229/22; 428/7–9; 211/178

[56] References Cited

UNITED STATES PATENTS

| | | | |
|---|---|---|---|
| 1,597,757 | 8/1926 | Berger | 229/22 X |
| 2,865,122 | 12/1958 | Clawson | 40/124.4 |
| 2,935,238 | 5/1960 | Koehler | 40/124.1 X |
| 3,178,227 | 4/1965 | Snyder | 229/22 X |
| 3,263,355 | 8/1966 | March | 40/124.4 |
| 3,483,742 | 12/1969 | Murray | 40/124.4 |

*Primary Examiner*—John F. Pitrelli

*Attorney, Agent, or Firm*—Wallenstein, Spangenberg, Hattis & Strampel

[57] ABSTRACT

A self-supporting, one-piece, collapsible device for holding greeting cards, particularly Christmas cards, to provide a decorative, Christmas tree-like display. The device, in its preferred form, is pyramidal in shape, the sidewalls of the device being foldable inwardly and downwardly for easy storage as well as easy extension to an uncollapsed, ready-to-use condition.

1 Claim, 7 Drawing Figures

CARD DISPLAY DEVICE

The present invention relates to a greeting card holding device.

Various Christmas tree simulating greeting card holding devices heretofore have been developed. Generally speaking, these prior devices comprise a plurality of parts which not only make their assembly by the user cumbersome and time consuming, but, also, do not lend themselves to either compact packaging for shipment by the manufacturer, or easy storage by a user. In addition, with certain of these prior devices, separate card holding means such as clips, are required to fasten the cards onto the card holding framework of the devices. In those instances where integral card support means is provided on the framework of the device, only a limited area of each card is in engagement with the support means causing the cards to droop thereby imparting an unattractive, untree-like appearance to the display.

In accordance with the present invention, a one-piece greeting card holding device is provided which can be easily and quickly unfolded from a collapsed, non-card holding condition to an extended, stable three dimensional card holding condition. The device is provided with integral card retaining means which enable a large number of greeting cards to be supported on the device in a manner to create a highly attractive, tree-like display. The device, after use, can be readily collapsed to a folded, compact condition for easy storage. The device, in addition, can be fabricated from inexpensive materials utilizing standard equipment.

The card holding device of the present invention, in brief, comprises a self-supporting, one-piece body portion having triangularly shaped sidewalls. The sidewalls are joined to each other along their lateral margins and are foldable along said margins to enable the body portion to be collapsed to a flattened, non-card holding condition. A plurality of spaced slots are provided in the sidewalls along the joined margins thereof for receiving and retaining greeting cards on the body portion. In its preferred form, the device has the shape of an elongated tetrahedron or pyramid. When cards have been inserted into all, or essentially all, of the slots in the sidewalls of the body portion, the device has a Christmas tree-like appearance, with the cards simulating the bows of the tree. The base of each sidewall of the body portion desirably is joined to an inwardly foldable panel or flap which acts to rest on a supporting surface and to stabilize the device when it is in its extended, card holding condition. The sidewalls also advantageously are provided with a centrally located transverse fold to enable the top of the body portion to be folded downwardly when the sidewalls are in a collapsed, non-card holding condition.

The foregoing, and other features and advantages of the invention will become apparent from the following description, when taken in conjunction with the accompanying drawing wherein.

Figure 1:
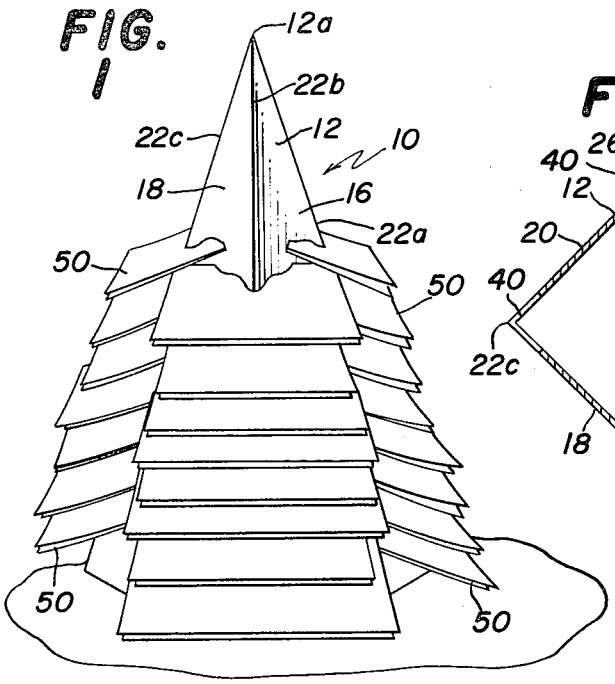
FIG. 1 is a view in perspective of an embodiment of the card holding device of the present invention as it appears with a full complement of greeting cards supported thereon.
Figure 3:
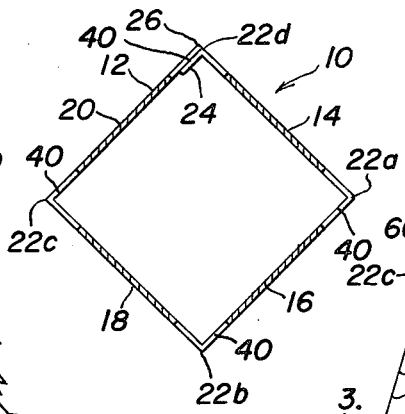
FIG. 3 is a sectional view taken substantially along line 3—3 of FIG. 2.
Figure 2:
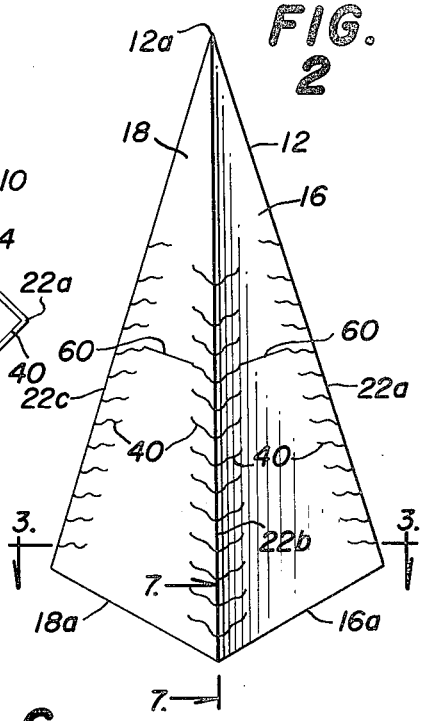
FIG. 2 is a view in perspective of said embodiment of the device in its extended condition ready to receive greeting cards.
Figure 4:
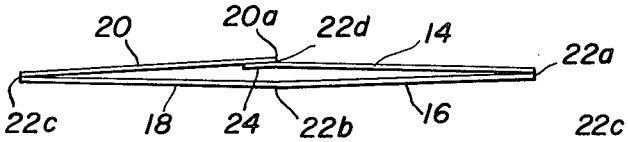
FIG. 4 is a bottom view in elevation showing said embodiment of the device in a collapsed condition.

As illustrated in FIGS. 1–3 of the drawing, the card holding device, designated generally by reference numeral 10, of the present invention, in its preferred form, comprises a unitary, one-piece, pyramidal body portion 12 having four triangular sidewalls 14, 16, 18 and 20. The sidewalls 14 and 16 are joined to one another along a core or fold line 22*a*, while the sidewalls 16 and 18, and 18 and 20, are joined to one another along score or fold lines 22*b* and 22*c*, respectively. The sidewall 14 is secured to the sidewall 20 by an anchoring flap 24 which is joined to the sidewall 14 along a score or fold line 22*d*. The flap 24 desirably is secured, as by gluing, to the inner surface of the sidewall 20 along the free margin 26 thereof.

Figure 6:
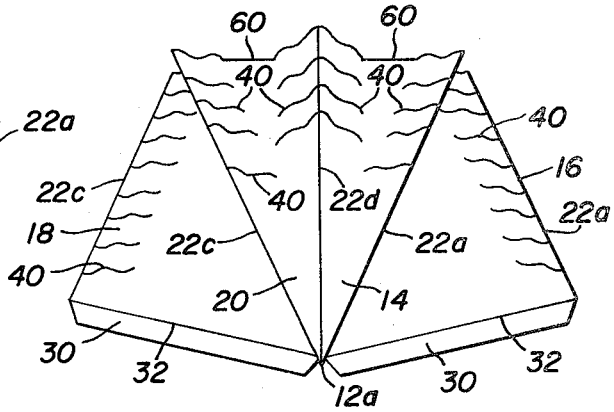
FIG. 6 is a front view in elevation showing said embodiment of the device in a collapsed condition with the top portion folded over.
Figure 5:
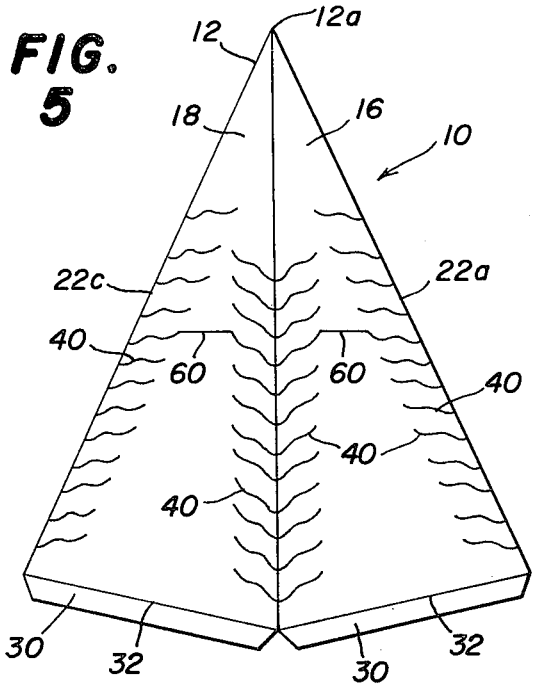
FIG. 5 is a front view in elevation showing said embodiment of the device in a collapsed condition.
Figure 7:
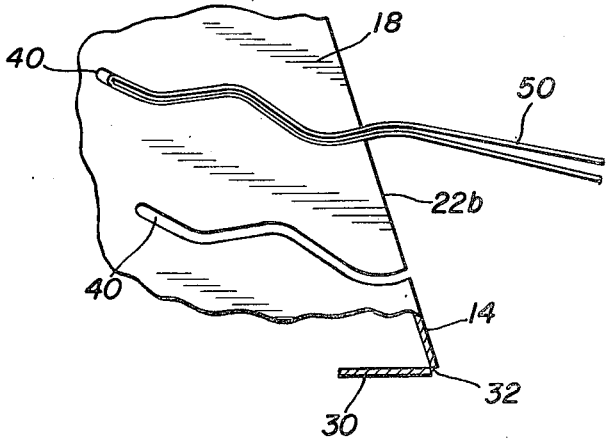
FIG. 7 is an enlarged fragmentary view, partly in section, taken substantially along line 7—7 of FIG. 2.

The score or fold lines 22*a*, 22*b*, 22*c* and 22*d*, at their upper ends, intersect at the apex 12*a* of the body portionn 12, and at their lower ends with the bases of their associated sidewalls 14, 16, 18 and 20. As best shown in FIGS. 5, 6 and 7 of the drawing, an inwardly foldable support panel 30 desirably is joined to the base of each of the sidewalls along a score or fold line 32.

Each of the sidewalls are provided along their lateral margins with a plurality of evenly spaced, inwardly and upwardly extending, curved slots 40. As shown in FIGS. 2, 5 and 6, the slots formed along one lateral margin of a sidewall intersect and are continuous with slots formed along the lateral margin of the next adjacent sidewall, and interrupt the score or fold lines 22*a*, 22*b*, 22*c* and 22*d* at their point of intersection. This arrangement enables greeting cards 50 (see FIGS. 1 and 7) to be readily and easily inserted into the slots 40 while at the same time providing optimum contact between the front and rear surfaces of the cards and the opposed edges of the slots 40. The cards, as a result, are firmly held in position in the slots 40. The angle at which the slots are formed in the sidewalls causes the greater area of each greeting card to extend outwardly and downwardly with relation to the body portion 12 in a manner which simulates the branches of a Christmas tree. The overall appearance of the device when the slots are filled, or nearly so, with cards, is highly suggestive of such a tree, and provides a unique and highly attractive holiday display.

To enable the device 10, after use, to be more compactly folded for easy storage, a transverse fold line 60 advantageously is provided in each of the sidewalls. The fold line 60 permits the upper or apex end of the body portion to be folded over (see FIG. 6) after the sidewalls have been collapsed as shown in FIG. 5. The device thereafter can be stored easily in a drawer or on a shelf until the next holiday season.

The device can be manufactured from various types of sheet stock including cardboard, paperboard, plastic, and even lightweight metal. The surface of the device desirably is provided with a decorative finish to enhance the appearance not only of the device itself, but, also, of the final display.

While there has been illustrated and described in detail herein what is presently considered to be a preferred embodiment of the present invention, it should be understood that various modifications and changes may be made in the described embodiment without departing from the spirit and scope of the invention.

What is claimed is:

1. A one-piece, collapsible device for holding greeting cards to provide a tree-like display, comprising: a one-piece, self-supporting, hollow body portion having four triangularly-shaped sidewalls and no bottom wall, said sidewalls being joined to one another along their lateral margins to impart a pyramidal configuration to the body portion when it is in an upright, non-collapsed position, the base or lower margin of each of the sidewalls being adapted to rest on a supporting surface and to maintain the body portion in an upright, non-collapsed position, said body portion being collapsible into a non-card supporting condition along any opposed two of said lateral margins to bring the two sidewalls on each side of said two opposed margins into flattened, overlying relation with respect to one another, a plurality of spaced, inwardly and upwardly extending slots formed in the sidewalls along the lateral margins thereof, the slots in each of the sidewalls intersecting at their outermost end the slots formed in the next adjacent sidewalls to provide continuous slots extending from one sidewall to the next adjacent sidewall through the lateral margins thereof, and a transverse fold line formed in each sidewall between the base and the upper end or apex thereof, said transverse fold line being positioned at the same level in each sidewall and intersecting the inner end of two laterally opposed slots formed along the lateral margins of the same sidewall, the fold lines and the slots intersected thereby of any two adjacent sidewalls enabling the area of said two sidewalls above the fold lines to be folded into overlying relation with respect to area thereof below the fold lines when the body portion is in its collapsed, non-card supporting condition.

* * * * *